US007029402B2

(12) United States Patent
Nakajima

(10) Patent No.: US 7,029,402 B2
(45) Date of Patent: Apr. 18, 2006

(54) GOLF CLUB SHAFT TIP DIAMETER ADJUSTER, GOLF CLUB SHAFT AND GOLF CLUB

(75) Inventor: Yoshifumi Nakajima, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 92 days.

(21) Appl. No.: 10/345,181

(22) Filed: Jan. 16, 2003

(65) Prior Publication Data

US 2003/0162605 A1 Aug. 28, 2003

(30) Foreign Application Priority Data

Feb. 28, 2002 (JP) ..... P2002-052833

(51) Int. Cl.
*A63B 53/02* (2006.01)

(52) U.S. Cl. ..... 473/309

(58) Field of Classification Search ..... 473/316–323, 473/309, 310
See application file for complete search history.

(56) References Cited

U.S. PATENT DOCUMENTS

| | | | | |
|---|---|---|---|---|
| 1,550,647 | A * | 8/1925 | Mattern | 473/310 |
| 1,774,385 | A * | 8/1930 | Lard | 473/319 |
| 1,851,439 | A * | 3/1932 | Mattern | 473/322 |
| 2,098,615 | A * | 11/1937 | Cowdery | 473/320 |
| 3,972,171 | A * | 8/1976 | Handschuch et al. | 57/406 |
| 4,023,802 | A * | 5/1977 | Jepson et al. | 473/309 |
| 4,076,430 | A * | 2/1978 | Crook, Jr. | 403/154 |
| 4,854,582 | A * | 8/1989 | Yamada | 473/309 |
| 5,049,422 | A * | 9/1991 | Honma | 428/34.6 |
| 5,275,399 | A * | 1/1994 | Schmidt et al. | 473/315 |
| 5,335,909 | A * | 8/1994 | Green, Jr. | 473/305 |
| 5,427,373 | A * | 6/1995 | Kusumoto | 473/319 |
| 5,547,427 | A * | 8/1996 | Rigal et al. | 473/345 |
| 5,575,723 | A * | 11/1996 | Take et al. | 473/305 |
| 5,692,970 | A * | 12/1997 | Nelson | 473/318 |
| 5,697,854 | A | 12/1997 | Aizawa et al. | |
| 5,766,089 | A * | 6/1998 | Dekura | 473/305 |
| 5,855,526 | A * | 1/1999 | Honma | 473/310 |
| 5,863,260 | A | 1/1999 | Butler, Jr. et al. | |
| 5,971,455 | A * | 10/1999 | Wolin et al. | 294/86.4 |
| 6,017,279 | A * | 1/2000 | Sumitomo | 473/316 |
| 6,142,677 | A * | 11/2000 | Sato et al. | 385/72 |
| 6,261,500 | B1 * | 7/2001 | Park et al. | 264/258 |
| 6,352,482 | B1 * | 3/2002 | Jacobson et al. | 473/310 |
| 6,354,963 | B1 * | 3/2002 | Kodama et al. | 473/345 |
| 6,420,652 | B1 * | 7/2002 | Byczek | 174/58 |

FOREIGN PATENT DOCUMENTS

| | | |
|---|---|---|
| JP | 4-47467 | 4/1992 |
| JP | 7-265469 | 10/1995 |

* cited by examiner

*Primary Examiner*—Stephen Blau
(74) *Attorney, Agent, or Firm*—Sughrue Mion , PLLC

(57) ABSTRACT

A golf club shaft tip diameter adjuster attached to a tip portion of a golf club shaft for adjusting a diameter of the shaft tip portion. The golf club shaft tip diameter adjuster is formed into a cylindrical tubular body out of fiber reinforced resin. A slit is defined to separate the tip diameter adjuster in the lengthwise direction thereof.

25 Claims, 6 Drawing Sheets

GOLF CLUB SHAFT TIP DIAMETER ADJUSTER, GOLF CLUB SHAFT AND GOLF CLUB

The present disclosure relates to the subject matter contained in Japanese Patent Application No.2002-52833 filed on Feb. 28, 2002, which is incorporated herein by reference in its entirety.

BACKGROUND OF THE INVENTION

1. Field of the Invention

The present invention relates to a golf club shaft tip diameter adjuster by which assembling of a golf club so as to correspond to various golf club heads different in shaft diameter is made easy so that a golf club shaft approved by a golfer and a golf club head approved by the golfer can be combined with each other in accordance with the affinities of the golfer; a golf club shaft using the golf club shaft tip diameter adjuster; and a golf club using the golf club shaft.

2. Description of the Related Art

Golf club shafts are roughly classified into shafts made of metal and shafts made of fiber reinforced resin (FRP). On the other hand, golf club heads to be attached to these shafts include heads made of wood (persimmon), heads made of metal, heads made of FRP, and composite heads of these materials. Such a golf club head is generally attached to such a golf club shaft through a bonding agent made of synthetic resin so as to be assembled into a golf club.

In recent years, increase of the dimensions of golf club heads, reduction of the weight of golf club shafts and increase of the length of golf club shafts are required of golf clubs. Particularly, high shock resistance in the shaft tip portion is required of the golf clubs. In addition, suitable combination of a golf club shaft with a golf club head in accordance with the diversification of golfers' affinities is desired, and assembling of a golf club matching with a wide variety of golf club heads different in shaft diameter is required.

SUMMARY OF THE INVENTION

Under the circumferences, the invention is to satisfy the requests in the related art, that is, to attain the following object.

That is, it is an object of the invention to provide a golf club shaft tip diameter adjuster by which assembling of a golf club so as to correspond to various golf club heads different in shaft diameter is made easy so that a golf club shaft approved by a golfer and a golf club head approved by the golfer can be combined with each other in accordance with the affinities of the golfer; a golf club shaft using the golf club shaft tip diameter adjuster; and a golf club using the golf club shaft.

To attain the foregoing object, the invention provides a golf club shaft tip diameter adjuster, a golf club shaft and a golf club as follows.

According to a first aspect of the invention, there is provided a golf club shaft tip diameter adjuster attached to a tip portion of a golf club shaft, for adjusting a diameter of the shaft tip portion, the adjuster including a cylindrical tubular body made of a fiber reinforced resin. The body defines a slit in a lengthwise direction thereof to separate the body.

According to a second aspect of the invention, an inner diameter of the golf club shaft tip diameter adjuster is smaller than an outer diameter of the shaft tip portion.

According to a third aspect of the invention, fibers included in the body are oriented in the lengthwise direction in a range of ±10° .

According to a fourth aspect of the invention, a resin material of the fiber reinforced resin is selected from the group consisting of epoxy resin, unsaturated polyester resin and acrylic resin.

According to a fifth aspect of the invention, a fiber material of the fiber reinforced resin is selected from the group consisting of glass fiber and carbon fiber.

According to a sixth aspect of the invention, the body has 20 mm–80 mm in length, 0.1 mm–0.5 mm in thickness, and 7.5 mm–10.0 mm in inner diameter.

According to a seventh aspect of the invention, there is provided golf club shaft including an end portion, and a golf club shaft tip diameter adjuster including a cylindrical tubular body made of a fiber reinforced resin. The body defines a slit in a lengthwise direction thereof to separate the body. The golf club shaft tip diameter adjuster is attached to the end portion.

According to a eighth aspect of the invention, there is provided a golf club including a golf club head, and a golf club shaft. The golf club shaft includes an end portion, and a golf club shaft tip diameter adjuster including a cylindrical tubular body made of a fiber reinforced resin. The body defines a slit in a lengthwise direction thereof to separate the body. The golf club shaft tip diameter adjuster is attached to the end portion. The golf club shaft is inserted into a shaft insertion hole of the golf club head.

According to a ninth aspect of the invention, in the first aspect of the invention, the elastic modulus of fibers of the fiber reinforced resin is not larger than 30 ton.

The golf club shaft tip diameter adjuster according to the first aspect is formed into a cylindrical tubular body out of fiber reinforced resin, while a slit is provided to separate the tip diameter adjuster lengthwise. Accordingly, the golf club shaft tip diameter adjuster can be attached to the tip portion of the golf club shaft so as to adjust the tip diameter of the golf club shaft desirably. Thus, the golf club shaft can be combined with a golf club head desirably in accordance with the diversification of golfers' affinities so as to be assembled into a golf club matching with a wide variety of golf club heads different in shaft diameter.

In addition, the slit is open when the tip diameter adjuster has been attached to the golf club shaft. Thus, there occurs an effect of constriction caused by the restoring force of the slit so that the tip diameter adjuster can be prevented from moving out of place at the time of working or the like. Further, since the slit portion is slightly open when the tip diameter adjuster has been attached to the golf club shaft, it can be confirmed that the tip diameter adjuster is in tight contact with the shaft tip.

The golf club shaft tip diameter adjuster according to the second aspect is formed so that the inner diameter thereof is smaller than the outer diameter of the shaft tip portion in the configuration defined in the first aspect. Accordingly, the slit is expanded when the tip diameter adjuster has been attached to the shaft. Thus, the shaft tip portion is constricted by the restoring force of the slit so as to show a good adhesive property.

In the golf club shaft tip diameter adjuster according to the third aspect, fibers included in the tip diameter adjuster are oriented lengthwise in a range of ±10° in the configuration defined in the first or second aspect. Accordingly, it is easy to form the tip diameter adjuster into a cylindrical shape, and it is easy to make the slit in the orientation direction.

BRIEF DESCRIPTION OF THE DRAWINGS

FIG. 1A is a schematic perspective view, and FIG. 1B is a plan view from the top.

DETAILED DESCRIPTION OF THE PREFERRED EMBODIMENTS

A golf club shaft tip diameter adjuster according to the invention will be described below in detail with reference to the drawings.

Figure 1A:
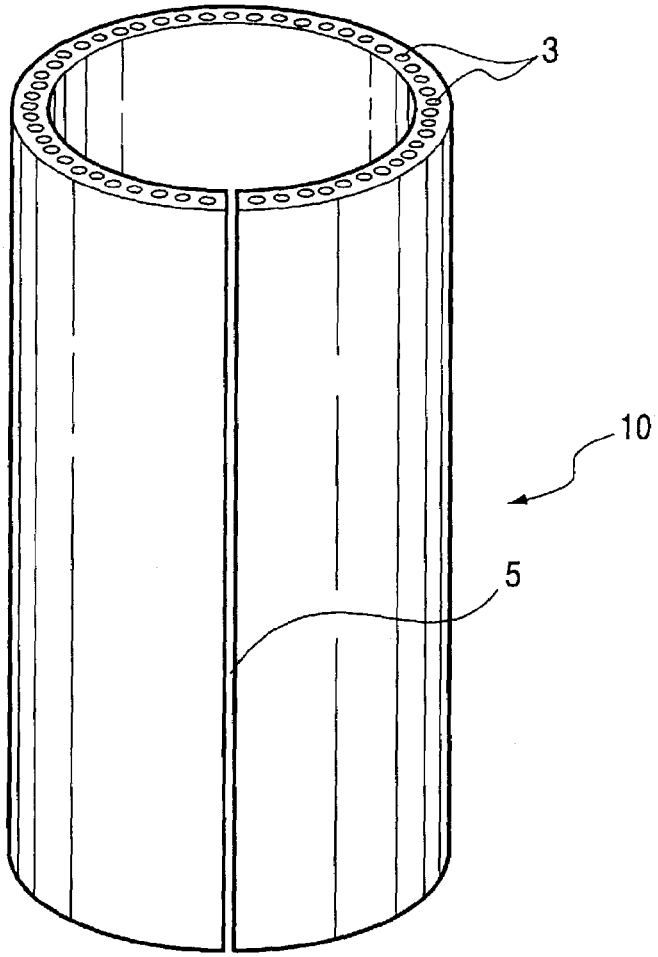
FIGS. 1A and 1B show a golf club shaft tip diameter adjuster according to an embodiment of the invention.
Figure 1B:
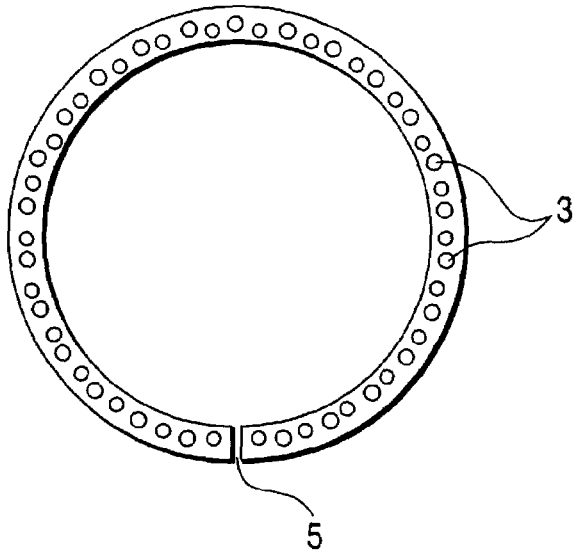
Figure 2:
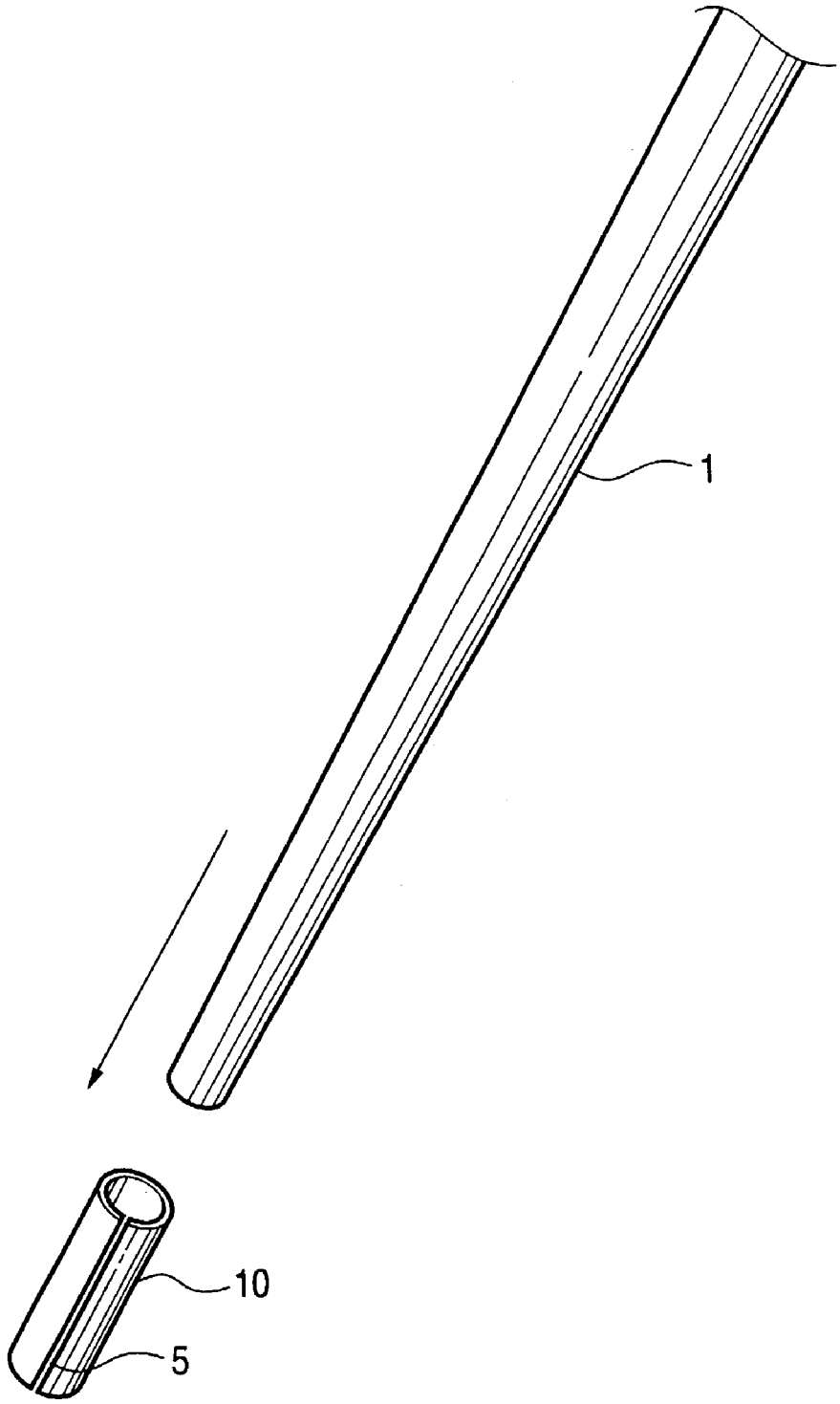
FIG. 2 is an explanatory view showing the state where the golf club shaft tip diameter adjuster will be attached to the tip of the golf club shaft.
Figure 3:
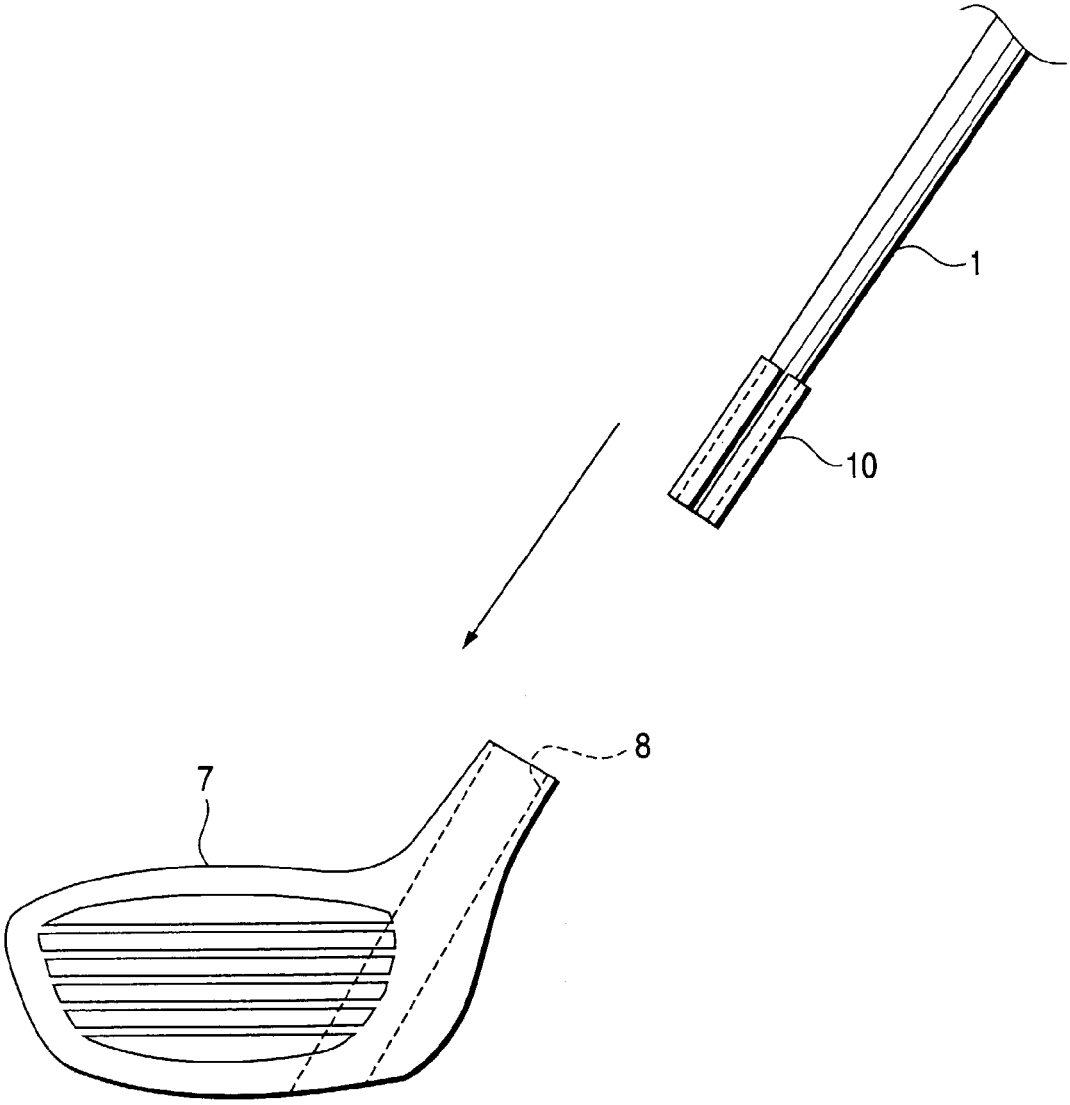
FIG. 3 is an explanatory view showing the state where a golf club head will be attached to the shaft to which the golf club shaft tip diameter adjuster has been attached.
Figure 5:
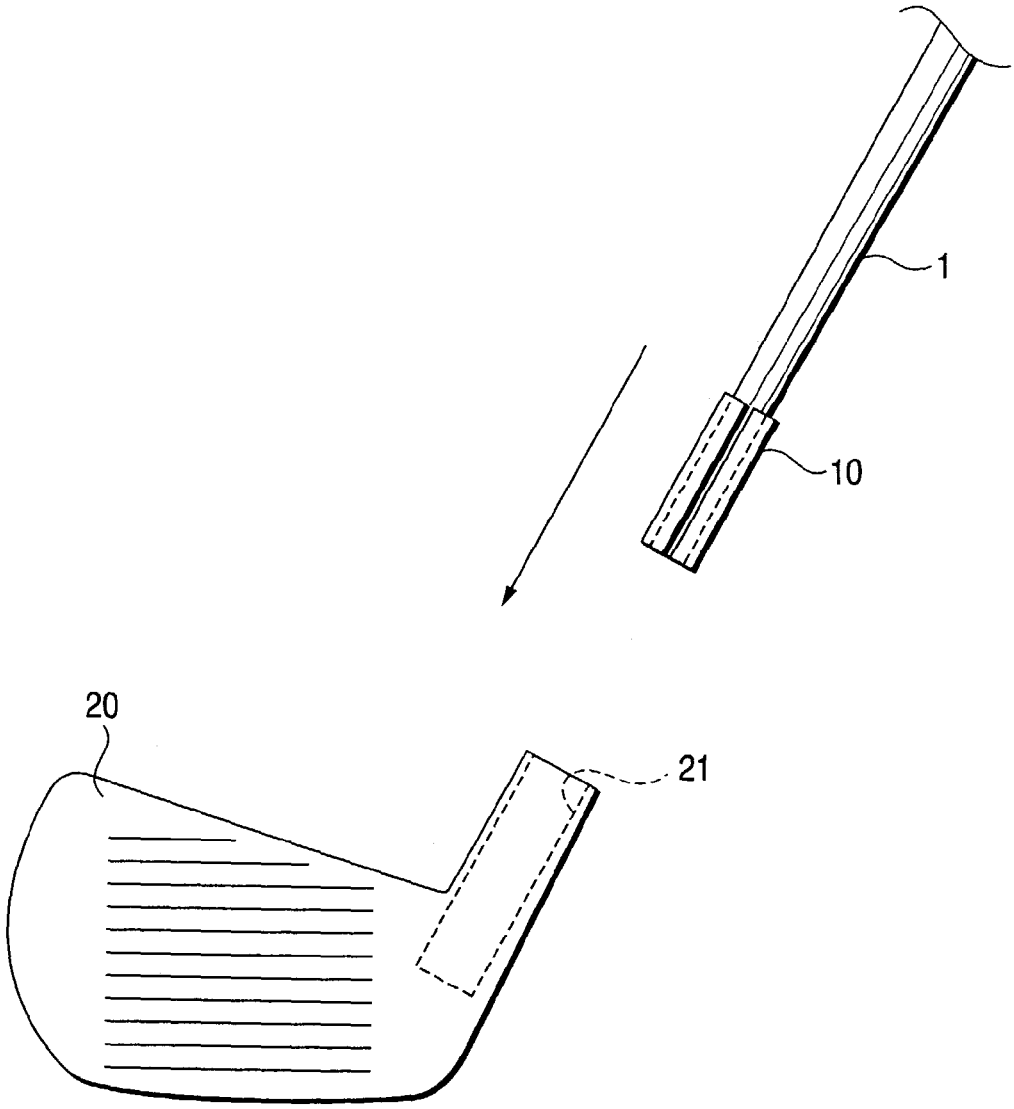
FIG. 5 is an explanatory view showing the state where a golf club head will be attached to the shaft to which the golf club shaft tip diameter adjuster has been attached.

FIG. 1A is a schematic perspective view showing a golf club shaft tip diameter adjuster according to an embodiment of the invention, and FIG. 1B is a plan view from the top thereof. For example, when a golf club shaft tip diameter adjuster 10 is used, the tip diameter adjuster 10 is attached to the tip portion of a golf club shaft 1 as shown in FIG. 2, and the golf club shaft 1 with the tip diameter adjuster 10 is inserted into a shaft insertion hole 8 of a driver head 7 as shown in FIG. 3. In addition, the golf club shaft 1 with the tip diameter adjuster 10 is used in attachment to a shaft insertion hole 21 of an iron head 20 as shown in FIG. 5.

The golf club shaft tip diameter adjuster 10 defines a slit 5 to separate the tip diameter adjuster 10 along with a lengthwise direction thereof as shown in FIG. 1A. Incidentally, before the tip diameter adjuster 10 is attached to the golf club shaft, the slit 5 of the tip diameter adjuster 10 is substantially closed so that the tip diameter adjuster 10 looks like a cylindrical tubular body.

In addition, it is preferable that the golf club shaft tip diameter adjuster 10 is formed so that the inner diameter thereof is smaller than the outer diameter of the tip portion of the shaft. Specifically, it is preferable that the golf club shaft tip diameter adjuster 10 is formed so that the inner diameter thereof is smaller by 0.05 mm–0.1 mm than the outer diameter of the tip portion of the shaft. As a result, the slit 5 is open when the tip diameter adjuster is attached to the shaft. Thus, there occurs an effect of constriction caused by the restoring force of the slit 5 so that the tip diameter adjuster 10 can be prevented from moving out of place during working. Further, since the slit 5 is slightly open when the tip diameter adjuster 10 is attached to the shaft, the tip diameter adjuster 10 is in tight contact with the shaft tip.

The dimensions of the golf club shaft tip diameter adjuster 10 is not limited particularly, but can be selected suitably in accordance with applications. The tip diameter adjuster 10 is preferably 20 mm–80 mm in length, 0.1 mm–0.5 mm (more preferably 0.2 mm–0.4 mm) in thickness, and 7.5 mm–10.0 mm in inner diameter.

For use in an iron club, the tip diameter adjuster 10 has preferably 20 mm–40 mm in length and 9 mm–10 mm in inner diameter.

For use in a wood club such as a driver, the tip diameter adjuster 10 has preferably 40 mm–70 mm in length and 7.5 mm–9 mm in inner diameter.

The resin material composing fiber reinforced resin of the golf club shaft tip diameter adjuster 10 is not limited particularly. Examples of such a resin material include epoxy resin, unsaturated polyester resin and acrylic resin. When the tip diameter adjuster 10 is attached to a shaft made of fiber reinforced resin (FRP), it is preferable to use the same resin as the fiber reinforced resin used for the golf club shaft in order to improve the adhesive property.

As the fiber material composing the fiber reinforced resin, it is preferable to use glass fiber, carbon fiber, or mixture fiber of glass fiber and carbon fiber. Incidentally, metal fiber such as titanium, boron fiber, amorphous fiber, organic fiber, and the like may be blended suitably in accordance with necessity.

It is preferable that the elastic modulus of the carbon fiber is not very high. When the elastic modulus is too high, the carbon fiber itself is so hard that the workability may deteriorate. The elastic modulus of the carbon fiber is preferably not higher than 30 ton.

It is preferable that fibers included in the golf club shaft tip diameter adjuster 10 are oriented in the lengthwise direction thereof in a range of ±10°, particularly in a range of ±0°.

When the orientation direction of the fibers is in the lengthwise direction (longitudinal direction) thereof, it is easy to form the tip diameter adjuster 10 into a cylindrical shape while it is easy to make the slit 5 in the orientation direction.

The golf club shaft tip diameter adjuster according to the invention can be manufactured by winding a UD prepreg sheet around a mandrel (iron core), cutting the sheet into predetermined dimensions and slitting the sheet in its lengthwise direction. Consequently, there is no fear that a mold release agent is mixed into the tip diameter adjuster as in injection molding. It is, therefore, possible to prevent the adhesive force from being lowered.

As for the method for attaching the golf club shaft tip diameter adjuster to the club shaft, a bonding agent is applied to the tip portion of the shaft 1, and the cylindrical tip diameter adjuster 10 is inserted and the boding agent is hardened sufficiently, as shown in FIG. 2. Thus, the tip diameter adjuster 10 can be fixedly bonded with the tip portion of the shaft 1. Incidentally, a bonding agent usually used may be selected and used suitably as the bonding agent.

There is no particular limit on the golf club shaft to which the golf club shaft tip diameter adjuster according to the invention will be attached. The golf club shaft may be either a metal shaft or a fiber reinforced resin (FRP) shaft.

In addition, the golf club shaft with the golf club shaft tip diameter adjuster according to the invention being attached to its tip portion can be combined with a desired golf club head in accordance with the diversification of golfers' affinities. Thus, it is possible to assemble a golf club matching with a wide variety of golf club heads different in shaft diameter.

Figure 4:
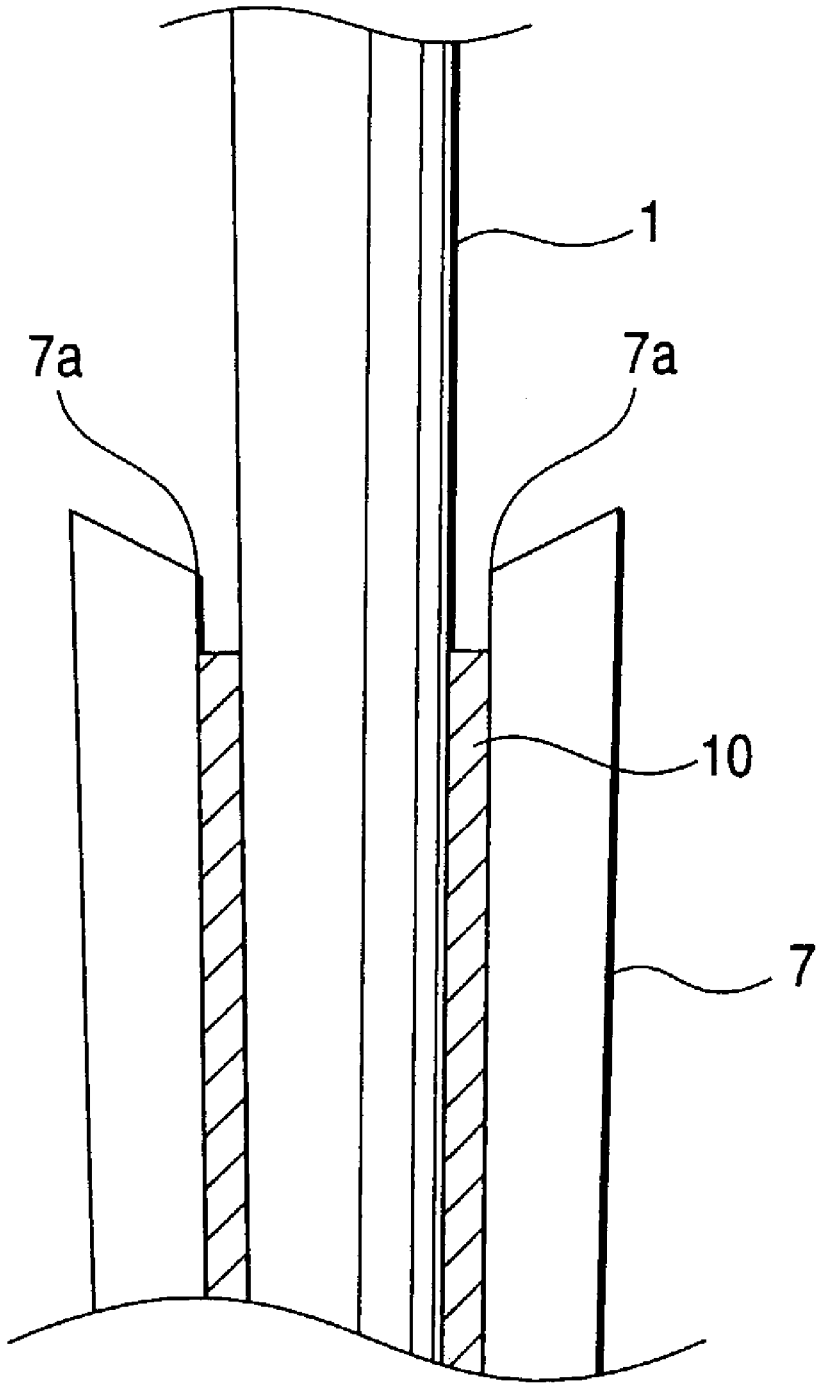
FIG. 4 is an enlarged partial sectional view showing the state where the shaft to which the golf club shaft tip diameter adjuster has been attached is attached to the golf club head.

Further, when the golf club shaft tip diameter adjuster 10 according to the invention is attached as shown in FIG. 4, an end surface 7*a* of the metal head can be prevented from abutting against the shaft 1 directly. Thus, the golf club shaft can be prevented from being damaged.

The golf club shaft tip diameter adjuster according to the invention has been described above specifically. However, the invention is not limited to the embodiment. Various modifications may be applied to the invention without departing from the scope and spirit of the invention.

EXAMPLE

An example and comparative examples will be shown below to describe the invention in more detail. However, the invention is not limited to the following example at all.

Example 1 and Comparative Example 1

A UD prepreg sheet (trade name: TR350E125S (made by Mitsubishi Rayon Co., Ltd.) including carbon fiber having an elastic modulus of 24 ton) was wound around a mandrel and hardened. The sheet was then cut into a cylindrical tubular body 65 mm in length, 8.5 mm in inner diameter and 0.2 mm in thickness, and a slit was made in the cylindrical tubular body in the lengthwise direction thereof. Thus, a shaft tip diameter adjuster as shown in FIGS. 1A and 1B was manufactured. Incidentally, fibers were oriented in the lengthwise direction (at about 0°) of this tip diameter adjuster.

A bonding agent was applied to the tip portion of a golf club shaft (tip diameter 8.6 mm) made of carbon fiber reinforced resin so that this tip diameter adjuster was fixedly bonded to the shaft. Thus, the tip diameter of the shaft became 9.0 mm (Example 1).

The golf club shaft to which the cylindrical tubular body had not been attached was used as Comparative Example 1.

<Izod Impact Test>

Figure 6:
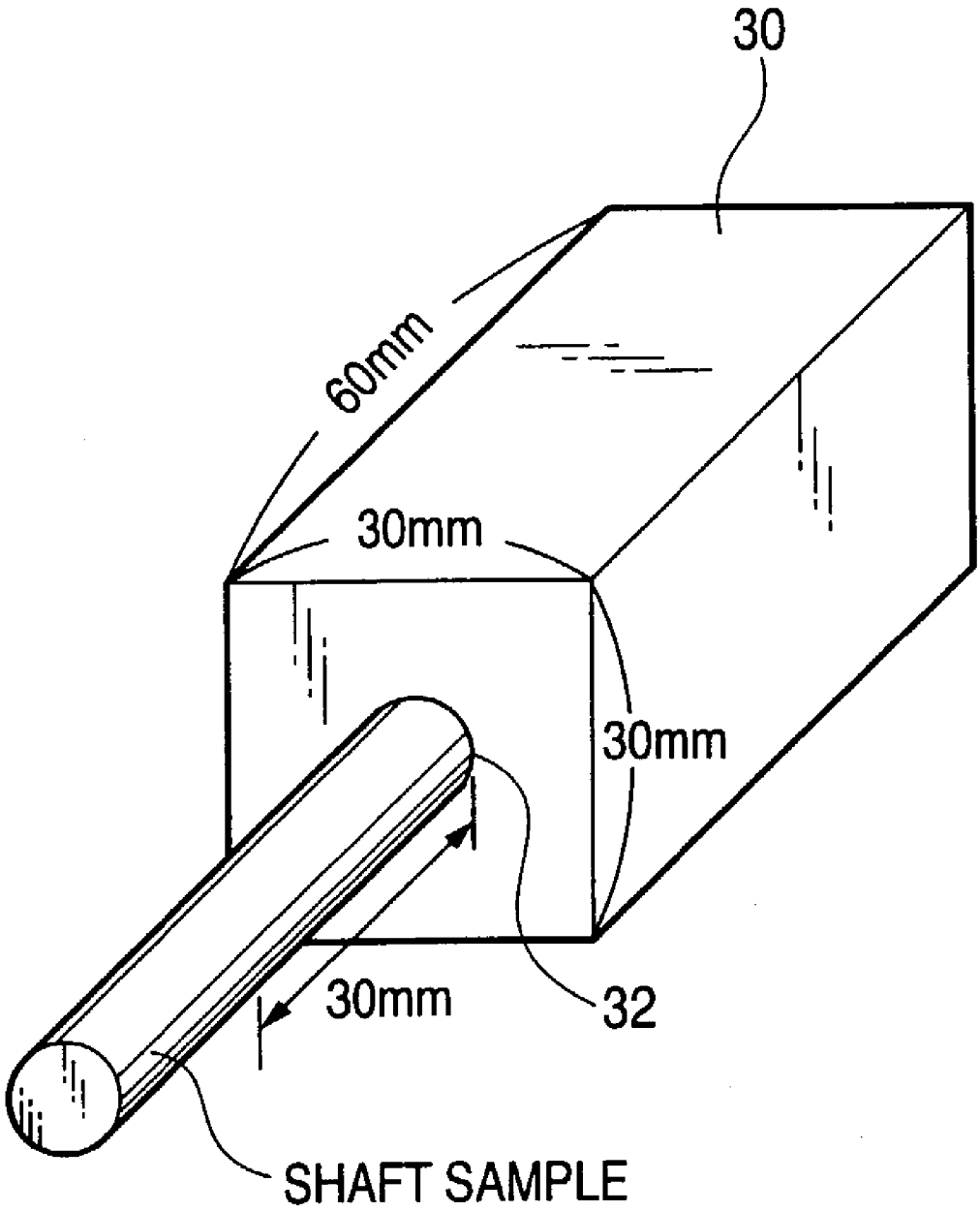
FIG. 6 is a schematic view for explaining an Izod impact test.

Shaft samples having 50–60 mm long were made up out of the golf club shafts according to Example 1 and Comparative Example 1. As shown in FIG. 6, each shaft sample was fixedly bonded to a shaft bonding hole 32 (having a hole structure similar to that of a general golf club head made of metal) of a shaft holder 30 made of metal so that a blade for Izod test would hit on the shaft sample 30 mm distant from the shaft holder. Thus, an Izod impact test (compliant with JIS K6911-1962) was performed. Table 1 shows the result. Incidentally, unit adopted in Table 1 is kgfcm.

TABLE 1

| | Comparative Example 1 | Example 1 |
|---|---|---|
| 1 | 173 | 210 |
| 2 | 216 | 194 |
| 3 | 196 | 189 |
| 4 | 180 | 220 |
| 5 | 174 | 196 |
| 6 | 200 | 230 |
| 7 | 156 | 218 |
| 8 | 190 | 208 |
| 9 | 178 | 230 |
| 10 | 221 | 241 |
| Average | 188.4 | 213.6 |
| Maximum | 221 | 241 |
| Minimum | 156 | 189 |

From the result of Table 1, it was confirmed that when the tip diameter adjuster according to the invention was attached, the Izod impact strength was improved by about 10% is comparison with that in Comparative Example 1.

<Durability Test>

Next, a wood type golf club head made of metal was attached to the golf club shaft according to Example 1 by use of an epoxy-based bonding agent, and a durability test was performed thereon with a Miyamae swing robot (head speed 45 m/s).

As Comparative Example 2, a cylindrical tubular body made of polyamide resin containing no fiber and having the same in dimensions as those of Example 1 was prepared and attached to a golf club head in the same manner, and a durability test was performed thereon in the same manner.

In Example 1, 500 blows were given to each of the toe side and the heel side from the center (each of positions 20 mm distant from the center respectively) of the hitting surface (face) of the golf club head in the Miyamae swing robot durability test. Even the 500 blows caused no peeling of the bonding layer and hence caused no turn of the golf club head. Thus, there was no problem.

On the other hand, in Comparative Example 2, 200 blows given in the Miyamae swing robot durability test caused peeling of the bonding layer and hence caused a turn of the golf club head.

As described above, according to the invention, a golf club shaft tip diameter adjuster is attached to a tip portion of a golf club shaft so that the golf club shaft can be combined with a desired golf club head suitably in accordance with the diversification of golfers' affinities. Thus, it is possible to assemble a desired golf club matching with a wide variety of golf club heads different in shaft diameter.

In addition, according to the invention, a golf club shaft tip diameter adjuster is attached to a tip portion of a golf club shaft so that the strength of the shaft tip portion can be enhanced. Thus, the impact strength is improved.

What is claimed is:

1. A golf club shaft tip diameter adjuster attached to a tip portion of a golf club shaft, for adjusting a diameter of the shaft tip portion, the adjuster comprising:

a cylindrical tubular body made of a fiber reinforced resin, wherein the body defines a slit in a lengthwise direction along the entire length of the adjuster thereof to separate the body.

2. The golf club shaft tip diameter adjuster according to claim 1, wherein an inner diameter of the golf club shaft tip diameter adjuster is smaller than an outer diameter of the shaft tip portion.

3. The golf club shaft tip diameter adjuster according to claim 1, wherein fibers included in the body are oriented in the lengthwise direction in a range of ±10°.

4. The golf club shaft tip diameter adjuster according to claim 3, wherein fibers included in the body are oriented in the lengthwise direction in a range of ±0°.

5. The golf club shaft tip diameter adjuster according to claim 1, wherein a resin material of the fiber reinforced resin is selected from the group consisting of epoxy resin, unsaturated polyester resin and acrylic resin.

6. The golf club shaft tip diameter adjuster according to claim 1, wherein a fiber material of the fiber reinforced resin is selected from the group consisting of glass fiber and carbon fiber.

7. The golf club shaft tip diameter adjuster according to claim 1, wherein the body has 20 mm–80 mm in length, 0.1 mm–0.5 mm in thickness, and 7.5 mm–10.0 mm in inner diameter.

8. The golf club shaft tip diameter adjuster according to claim 7, wherein the body has is 0.2 mm–0.4 mm in thickness.

9. The golf club shaft tip diameter adjuster according to claim 1, wherein the elastic modulus of fibers of the fiber reinforced resin is not larger than 30 ton.

10. The golf club shaft tip diameter adjuster according to claim 1, wherein an inner diameter of the golf club shaft tip diameter adjuster is 0.05 mm to 0.1 mm smaller than an outer diameter of the shaft tip portion.

11. A golf club shaft comprising:

an end portion; and a golf club shaft tip diameter adjuster including a cylindrical tubular body made of a fiber reinforced resin, wherein the body defines a slit in a lengthwise direction along the entire length of the adjuster thereof to separate the body; and the golf club shaft tip diameter adjuster is attached to the end portion.

12. The golf club shaft according to claim 11, wherein said shaft is made from the same fiber reinforced resin as said tubular body.

13. A golf club comprising:

a golf club head; and a golf club shaft, wherein the golf club shaft includes:

an end portion;

a golf club shaft tip diameter adjuster including a cylindrical tubular body made of a fiber reinforced resin;

wherein the body defines a slit in a lengthwise direction along the entire length of the adjuster thereof to separate the body;

wherein the golf club shaft tip diameter adjuster is attached to the end portion; and wherein the golf club shaft is inserted into a shaft insertion hole of the golf club head.

14. The golf club according to claim 13, wherein the golf club is an iron and the diameter adjuster has a length of 20 mm to 40 mm and an inner diameter of 9 mm to 10 mm.

15. The golf club according to claim 13, wherein the golf club is a wood and the diameter adjuster has a length of 40 mm to 70 mm and an inner diameter of 7.5 mm to 9 mm.

16. The golf club according to claim 13, wherein said shaft is made from the same fiber reinforced resin as said tubular body.

17. The golf club according to claim 13, wherein said diameter adjuster is coupled to said shaft with a bonding agent.

18. The golf club according to claim 13, wherein said diameter adjuster is positioned such that a surface of said golf club head is prevented from contacting a surface of said shaft.

19. The golf club according to claim 13, wherein an inner diameter of the golf club shaft tip diameter adjuster is smaller than an outer diameter of the shaft tip portion, prior to said diameter adjuster being placed on said shaft.

20. The golf club of claim 13, wherein the elastic modulus of fibers of the fiber reinforced resin is not larger than 30 ton.

21. A golf club shaft tip diameter adjuster attached to a tip portion of a golf club shaft, for adjusting a diameter of the shaft tip portion, the adjuster comprising:

a cylindrical tubular body made of a fiber reinforced resin, wherein the body defines a slit in a lengthwise direction along the entire length of the adjuster thereof to separate the body; and wherein fibers included in the body are oriented in the lengthwise direction in a range of ±10°.

22. The golf club shaft tip diameter adjuster according to claim 21, wherein an inner diameter of the golf club shaft tip diameter adjuster is smaller than an outer diameter of the shaft tip portion.

23. The golf club shaft tip diameter adjuster according to claim 21, wherein a resin material of the fiber reinforced resin is selected from the group consisting of epoxy resin, unsaturated polyester resin and acrylic resin.

24. The golf club shaft tip diameter adjuster according to claim 21, wherein a fiber material of the fiber reinforced resin is selected from the group consisting of glass fiber and carbon fiber.

25. The golf club shaft tip diameter adjuster according to claim 21, wherein the body has 20 mm–80 mm in length, 0.1 mm–0.5 mm in thickness, and 7.5 mm–10.0 mm in inner diameter.

* * * * *